US005445373A

United States Patent [19]

Franks

[11] Patent Number: 5,445,373

[45] Date of Patent: Aug. 29, 1995

[54] NIGHT GOLF SYSTEM

[75] Inventor: Randy Franks, Lake Oswego, Oreg.

[73] Assignee: Night Golf, Inc.

[21] Appl. No.: 72,788

[22] Filed: Jun. 3, 1993

[51] Int. Cl.[6] ..... A63B 69/36

[52] U.S. Cl. ..... 273/32 R; 273/176 R

[58] Field of Search ..... 273/176, 32 R, 35 R, 273/35 B, 35 A; 362/253, 234

[56] References Cited

U.S. PATENT DOCUMENTS

| | | | |
|---|---|---|---|
| 2,694,573 | 11/1954 | Walter | 273/32 R |
| 3,351,347 | 11/1967 | Smith et al. | 273/213 |
| 3,458,205 | 7/1969 | Smith et al. | 273/213 |
| 3,464,703 | 9/1969 | Vallas | 273/176 |
| 3,539,794 | 11/1970 | Mckay et al. | 240/2.25 |
| 3,576,987 | 5/1971 | Voight et al. | 240/2.25 |
| 3,649,029 | 3/1972 | Worrell . | |
| 3,661,790 | 5/1972 | Dean et al. | 252/301.3 |
| 3,709,495 | 1/1973 | Krombein . | |
| 3,774,022 | 11/1973 | Dubrow et al | 240/2.25 |
| 3,782,730 | 1/1974 | Horchler | 273/213 |
| 3,918,719 | 11/1975 | Welch | 273/176 |
| 4,015,111 | 3/1977 | Spector | 240/2.25 |
| 4,108,439 | 8/1978 | McGuire | 273/176 |
| 4,235,441 | 11/1980 | Ciccarello | 273/213 |
| 4,419,655 | 12/1983 | May | 340/323 |
| 4,479,649 | 10/1984 | Newcomb et al. | 273/61 |
| 4,564,199 | 1/1986 | Adams | 273/213 |
| 4,596,382 | 6/1986 | Walker | 273/183 |
| 4,614,340 | 9/1986 | Hosoya | 273/213 |
| 4,798,386 | 1/1989 | Berard | 273/235 |
| 4,846,475 | 7/1989 | Newcomb et al. | 273/128 |
| 4,984,787 | 1/1991 | Nesbit et al. | 273/1.5 R |
| 4,991,851 | 2/1991 | Melesio | 273/213 |
| 5,076,586 | 12/1991 | Taniguchi et al. | 273/176 AR |
| 5,085,438 | 2/1992 | Takeno | 273/212 |
| 5,265,875 | 11/1993 | Fitzgerald | 273/176 A |

FOREIGN PATENT DOCUMENTS

| | | | |
|---|---|---|---|
| 1086566 | 10/1967 | United Kingdom | 273/176 A |

OTHER PUBLICATIONS

Shenton, 24 Hours of Golf a Day Rise or Shine, Jul. 29 pp. 29, 20, 30, 31.

*Primary Examiner*—Mark S. Graham

*Attorney, Agent, or Firm*—Marger, Johnson, McCollom & Stolowitz

[57] ABSTRACT

A portable lighting system that is disclosed for use in coordination with a glow-in-the-dark golf ball. Various predetermined locations on the golf course are illuminated so that a golfer can see the general layout and various hazards of each golf hole on the golf course. The golf course, other than the predetermined illuminated locations, however, remains substantially unlit so that a high contrast is created between the glow-in-the-dark golf ball and the golf course backdrop. The lighting system comprises various portable recharged lights that are hauled between different golf courses in a trailer. The trailer contains a power supply that recharges the illumination units after a night golf session. A light-stick is used to illuminate the area around a golfer while navigating around the golf course. The carrying stick is inserted into the ground before a golf shot to illuminate the area immediately surrounding the golf ball.

16 Claims, 9 Drawing Sheets

NIGHT GOLF SYSTEM

BACKGROUND OF THE INVENTION

This invention relates generally to a golf course lighting system and more particularly to a portable system to provide an inexpensive, easy-to-install way to play golf at night.

A significant amount of time is required to complete an entire eighteen hole round of golf or even to complete a partial round of nine holes. An expert golfer may take up to three hours to complete an entire golf round where a novice golfer may require even more time. If a golf course is being heavily used by many golfers at the same time, the amount of time required to complete a golf round is further increased.

Because of the extensive time requirements, and because golf can only be played outdoors, the number of hours available for playing golf within any 24 hour period is very limited. For example, during the winter months, when it becomes dark relatively early, it would be impossible for a golfer, after a typical eight hour workday, to complete a round of golf before it got dark. In some golf course locations, during the summer months it is too hot to comfortably play golf during the middle of the day. However, as the temperature falls later into the evening, it is too dark to play golf. This limited time window for playing golf limits the number of total rounds that can be played on any one golf course over a year and prevents many people with restrictive schedules from golfing as often as they would like.

To increase the number of hours in a day in which golf can be played, lights have been installed on some golf courses. However, a golf course covers a significant amount of land. For example, a typical golf course can encompass over 100 acres. This amount of area requires a large number of lights to sufficiently light the entire golf course. In addition, because the golf ball is relatively small and is hit a relatively long distance (i.e., up to 300 yards), there must be even more lighting than might normally be imagined.

For example, conventional golf course lighting must illuminate the golf ball while lying on the ground and while traveling in the air. The ground area must be sufficiently illuminated so that a golfer can locate the relatively small golf ball from a sufficient distance away. The sky above the golf course must also be sufficiently illuminated so that after the golf ball is hit with a golf club, the golfer can see the trajectory of the ball while it is traveling through the air. Being able to see the ball trajectory is important for identifying the approximate location where the golf ball lands after being hit with the golf club. Being able to see the golf ball trajectory is also necessary so that a golfer can fully appreciate the quality of his shot, thereby increasing the golfers enjoyment of the golf round.

Previous attempts to light golf courses involve attaching large, high voltage, alternating current (AC) driven lamps at various locations around the golf course. The lights are mounted high above the ground to provide the most effective location for lighting the most area on each golf hole. The lights are either attached to poles mounted into the ground or attached to trees that presently reside around the golf course. Underground cable is then run from a public power supply to each light on the golf course.

A conventional lighting system is, however, prohibitively expensive to install since cable must be routed through the ground to every remote location on the golf course, some locations being in upwards of one or two miles from the closest power source. Digging underground trenches for running the cable is also expensive and can destroy the quality and aesthetic beauty of the golf course. The lights are also expensive, since they must produce a maximum number of foot candles to illuminate the largest amount of space. Lamps of this size use a large amount of wattage and, therefore, are also expensive to operate. In addition, the lamps must be constantly replaced which increases golf course maintenance costs. Since the lamps must be positioned high above the ground, it is also very time consuming and dangerous for maintenance personnel to travel to each light location, position a ladder underneath the light, and climb the ladder up to the light fixture to replace the lamp.

If the lamps are attached to specially constructed support poles, the poles create an additional obstruction that would not otherwise exist on a non-lighted golf course. These poles detract from the quality of the golf course during daytime play. For lamps that are attached to trees surrounding the golf course, a power cable must be run from the ground to the lighting fixture. The cable is supported with clamps mounted into the tree. These clamps along with the lighting fixture mountings can damage or kill the tree. The power cables and lighting fixtures also detract from the aesthetic beauty of the golf course during the day, which is a significant factor to a golfer's overall enjoyment of the golf course. Because of the physical size of each high wattage light and the time required to mount the lights above the ground on special support poles or trees, it would not be practical for the lighting fixtures to be removed every day. Therefore, the lamps and lighting fixtures are exposed to year-round weather conditions that decrease the operating life of the lighting system.

Some attempts have been made to provide portable golf course lighting. However, the portable light source is insufficient for effectively playing golf at night. For example U.S. Pat. No. 3,918,719 to Welch shows a transportable light that is attached to a golf cart to illuminate spots on a golf course at night. This light, however, does not effectively identify the overall layout of a golf hole. Thus, the golfer often will not know where to direct his golf shot. In addition, the light source is attached to a golf cart, which cannot illuminate a golf ball outside the limited range of the golf cart. This would make it difficult to track the trajectory of the golf ball after being hit with a golf club and to find the golf ball after it returns to the ground.

Previous methods for playing golf at night include using glow-in-the-dark golf balls. Illuminated golf balls are known in the art and are described in detail in U.S. Pat. No. 3,351,347 to Smith et. al., U.S. Pat. No. 3,458,205 to Smith et. al., U.S. Pat. No. 4,798,386 to Berard, and U.S. Pat. No. 4,991,852 to Melesio. While an illuminated golf ball provides sufficient contrast for easy identification at night, the golfer still does not know where to direct his golf shot and can not identify the specific hazards on each golf hole. For example, the golfer would not be able to see a sand trap, water hazard, or trees that determine where the golf shot should be directed.

Accordingly, a need exists for a low cost, portable golf course lighting system that allows a golfer to easily observe the golf ball during all stages of the golf game and that allows the golfer to discern the general layout and hazards of each golf hole.

SUMMARY OF THE INVENTION

A permanently mounted lighting system is also limited in utility. For example, if the lighting structures were portable they could be transported between different golf courses. Portable fixtures allow several courses to offer night golf play and distribute the overall cost of the system among them. Portable lighting fixtures as disclosed herein can be maintained in one central location and thereby eliminate maintenance personnel from having to travel to each remote light location. The lighting fixtures can be removed during the day to preserve the natural beauty of the golf course.

It is, therefore, an object of the invention to increase the number of hours each day in which golf can be effectively played on a golf course.

Another object of the invention is to reduce the cost and time for installing and maintaining a golf course lighting system.

Still another object of the invention is to increase the effectiveness of a lighting system in providing an enjoyable means for playing golf at night.

A further object of the invention is to increase the utility of golf course lighting systems by transporting a single lighting system between different golf courses depending upon which golf course plans on offering a night golf session.

One aspect of the invention is a portable lighting system for use in coordination with a glow-in-the-dark golf ball. Various predetermined locations on the golf course are illuminated so that a golfer can see the general layout and various hazards of each golf hole on the golf course. The golf course, other than the predetermined illuminated locations, however, remains substantially unlit so that a dark sky backdrop and a dark ground level are maintained. The dark sky backdrop provides a sufficient contrast with the glow-in-the-dark golf ball so that a golfer can easily see the trajectory of the golf ball while sailing through the air after being struck with a golf club. The dark ground level also maintains sufficient contrast with the glow-in-the-dark golf ball so that the golfer can easily locate the golf ball while it is lying on the ground.

Maintaining a high contrast between the golf ball and the golf course allow a golfer to easily locate his golf ball. The high contrast also increases the enjoyment a golfer has by viewing his golf ball as it sails across the sky. The lighting system illuminates specific locations on the golf course that sufficiently identify the layout of each golf hole. This spot illumination informs the golfer as to his present location on the golf hole and where to direct his next golf shot. Since a majority of the golf course remains unlit, fewer and less powerful lights are required. Since the lights are smaller, they can be transported between different golf courses in a trailer. This increases the utility of the lighting system since the lighting system can be used on more than one golf course.

Various types of portable illumination units are used, each having a light source and a rechargeable battery. The lights are temporarily placed on the ground so that their light sources illuminate the previously identified spot locations. The night golf system also includes a trailer that stores and moves the illumination units to various locations on one specific golf course and also moves the illumination units between different golf courses. The trailer also contains a battery charger that recharges the illumination units in preparation for a night golf session. The illumination units are capable of maintaining a charge for a sufficient amount of time to complete at least one night golf session.

Selection among the various illumination units depends upon where they are to be used on the golf course. For example, fairway illumination units are used to allow a golfer to identify hazards and the general layout of the golf course. Fairway markers are used to identify predetermined distances from golf greens. Illuminated tee-box markers identify tee-box locations on the golf course and golf green illumination units identify where the golf cup on each golf green is located. Each fairway illumination unit, fairway marker, tee-box marker, and golf green illumination unit can be hand carried to any location on the golf course.

The night golf system also includes a light-stick. The light-stick comprises a portable light source attached to a carrying stick. The lightsource illuminates the path immediately in front of a golfer while navigating around the golf course. The carrying stick is inserted into the ground by the golfer before addressing the golf ball and the light source is directed to illuminate the area surrounding the golf ball.

Each fairway illumination unit and green illumination unit contains a control circuit that is coupled between a battery and the light source. The control circuit activates the light source when the outside light level falls below a predetermined light level. The predetermined light level is that in which golf can no longer be easily played without artificial lighting. The control circuit also allows both the light source and battery to be tested and includes a timer that automatically shuts-off the light source after a predetermined amount of time. The timer prevents the battery from being damaged due to severe discharge and obviates manual shut-off of each illumination unit after a night golf session. The fairway illumination units have multiple lamps that can be rotated in various vertical and horizontal directions.

The green illumination unit includes a mounting bracket that is inserted into the top of a golf pole. The golf pole is specially designed so that it can be inserted into a standard golf cup while simultaneously holding the green illumination unit above the ground. The green illumination unit sufficiently illuminates the green so that the golfer can exchange the glow-in-the-dark golf ball with a standard non-illuminating golf ball while putting. The fairway markers and tee-box markers each include a small light and a small rechargeable battery and have a spike that is inserted into the ground to hold the marker upright above the ground. The markers are used to identify the tee-boxes, specific distances from the golf greens, and various hazards on the golf course.

The trailer includes an electrical distribution system for recharging the lighting units when stored therein. The electrical distribution system includes a battery charger and multiple power outlets. Some of the power outlets comprise plugs that are quickly inserted into associated receptacles located on fairway or green illumination units and some of the power outlets comprise clips that are capable of receiving the rechargeable batteries from associated fairway or tee-box markers.

The foregoing and other objects, features and advantages of the invention will become more readily apparent from the following detailed description of a preferred embodiment of the invention which proceeds with reference to the accompanying drawings.

DETAILED DESCRIPTION

Figure 1:
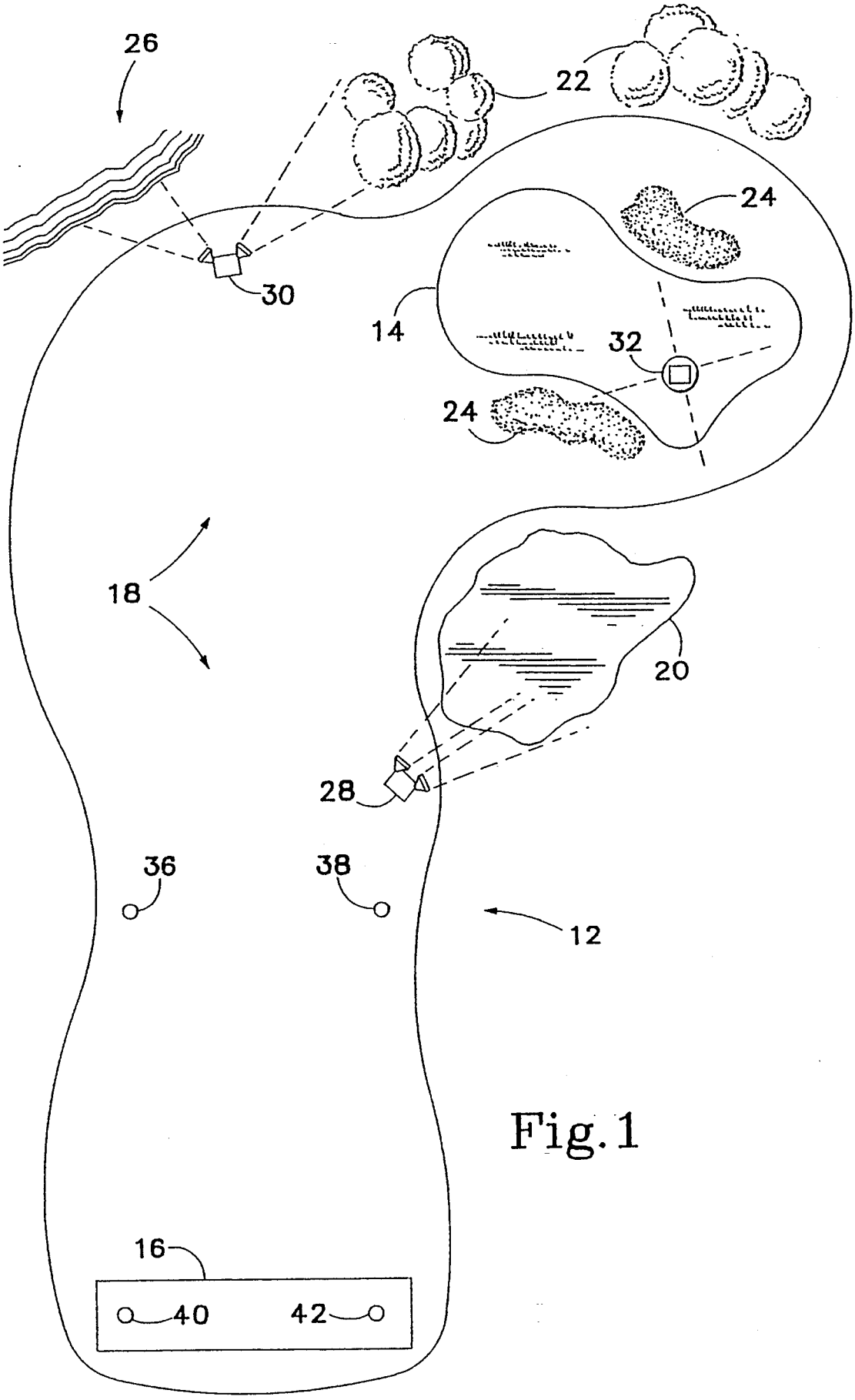
FIG. 1 is a top plan view of the lighting system according to the invention installed on a conventional golf course hole.

FIG. 1 is a top plan view showing part of the night golf lighting system according to the invention installed on a conventional golf course hole 12. The golf hole 12 comprises a tee-box 16 where a golfer initially attempts to drive a golf ball into a fairway 18. The golfer, upon locating his golf ball in the fairway 18, attempts to hit the ball onto green 14. After landing on green 14, the golfer putts the golf ball into a golf cup that has been previously dug into the green (not shown). Conventional golf courses have natural hazards located on each golf hole to increase the challenge of placing the golf ball into the golf cup in the fewest number of golf strokes. For example, on hole 12, a pond 20 resides on the right side of the fairway 18, a hill 26 (indicated by contour lines) resides on the outside of the fairway bend (dogleg), trees 22 reside to the back of the green 14, and sand traps 24 are located on the front and back of the green 14.

Some components of the night golf system according to the invention are shown installed on golf hole 12 and will now be described. However, it is important to note that the specific locations of various pieces of the night golf system change relative to each golf hole and between different golf courses. Thus, the description below is only one possible way in which to install the night golf system and is given simply as one example on how to effectively illuminate a golf hole.

The night golf system includes various lights that illuminate different locations on golf hole 12. The lights include tee-box markers 40 and 42 located on either side of tee-box 16 and fairway markers 36 and 38 located on opposite sides of the fairway 18. The system also includes fairway illumination units 28 and 30 located at the inside and outside bends of the fairway dogleg, respectively, and a green illumination unit 32 located on the green 14.

Tee-box markers 40 and 42 are located on opposite sides of the tee-box 16 to identify the specific location where a golfer must tee off. Fairway markers 36 and 38 are located at some predetermined distance from the green 14. For example, typical golf holes have some type of marker (e.g., trees) that are conventionally located 150 yards from a golf green. Thus, fairway markers 36 and 38 serve the same purpose of providing a reference point for golfers at night to determine how far away they are from the green 14. Additional tee-box or fairway markers can be placed at other locations to identify other objects on the golf course. For example, an additional marker can be placed on the outside of the fairway 18 to indicate an area that is out-of-bounds or a marker can be placed along a footpath to indicate where a golfer should go while walking along the golf course.

Multiple fairway illumination units are located at various locations on each golf hole to allow a golfer to determine the general layout of the golf hole at night. For example, on golf hole 12, fairway illumination unit 28 is positioned to identify the inside bend of the fairway 18 dogleg. In addition, unit 28 partially illuminates pond 20 so a golfer can direct his golf shot away from this water hazard. Fairway illumination unit 30 is located on the outside of the fairway dogleg and is directed at both hill 26 and trees 22. Thus, unit 30 identifies to a golfer the end of the fairway 18 and identifies the hazardous trees 20 to the back of the green.

It is important to remember that a glow-in-the-dark golf ball is used during the night golf session. Therefore, the fairway illumination units do not have to light the entire fairway 18. The purpose of fairway illumination units 28 and 30 are simply to identify the general layout of the golf hole, so that a golfer will know where to direct his golf shot. In fact, if too much light was provided, it would be harder for a golfer to locate his golf ball since there would be less contrast between the golf ball and the ground. Thus, illumination unit 30, is directed at hill 26 and trees 22 only illustrate the outside edge of the fairway 18. The layout of the outside edge of golf hole 12 is identified, however, without significantly interfering with the natural dark backdrop which allows a golfer to easily observe the trajectory of the illuminated golf ball after hitting it with a golf club. In addition, the fairway illumination units do not illuminate a substantial amount of the golf course surface. The dark surface makes it easy to locate the golf ball while lying on the ground.

Green illumination unit 32 is located directly over the cup (not shown) in the golf green 14. The green illumination unit 32 identifies the location of the golf green 14 and specifically the location of the golf cup. Sufficient light is provided by the green illumination unit 32 so that a golfer, after placing his ball on the green 14, can replace the glow-in-the-dark golf ball with a conventional non-illuminating golf ball. The conventional golf ball is substituted for more accurate putting.

Figure 2:
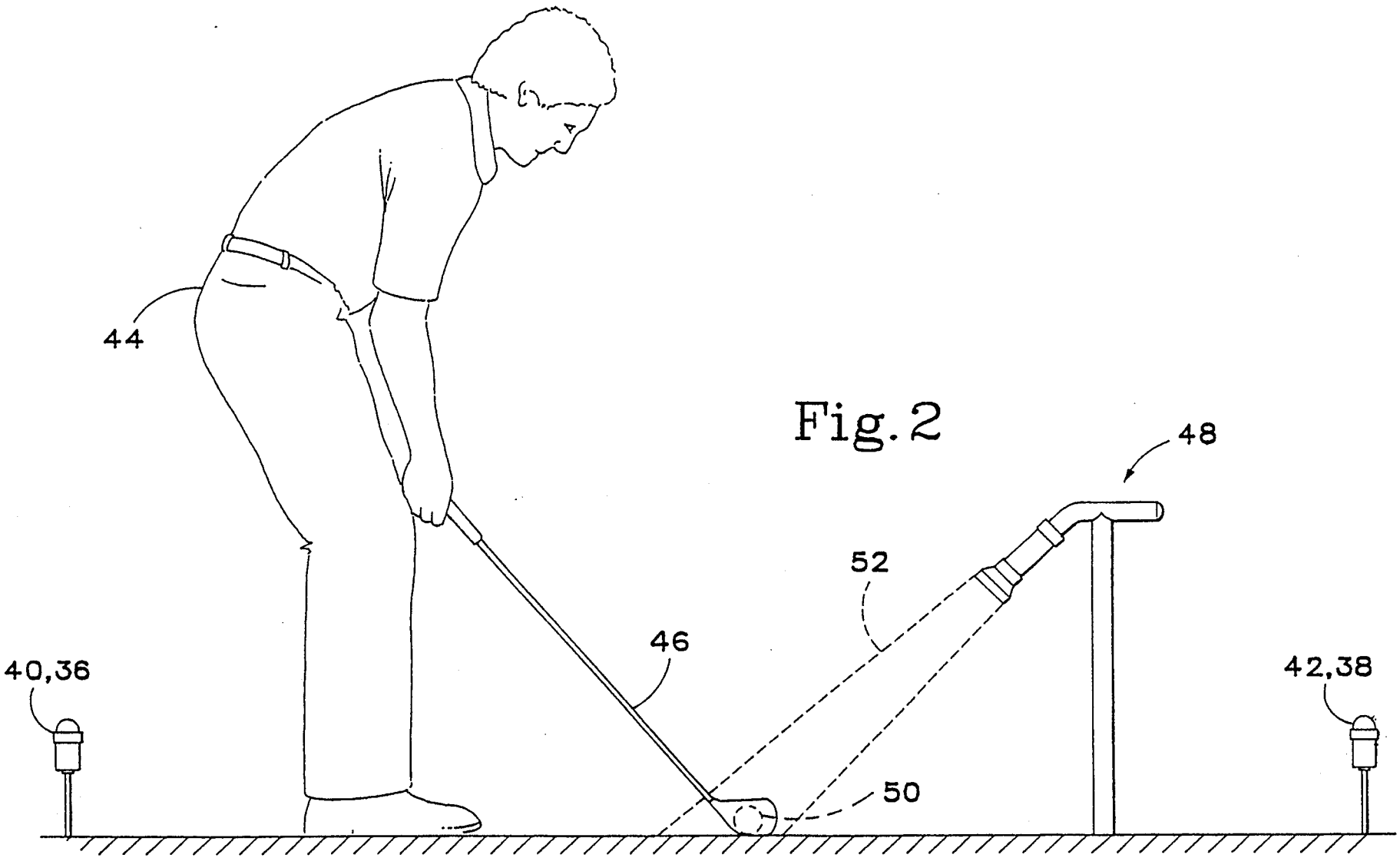
FIG. 2 shows a golfer addressing a glow-in-the-dark golf ball illuminated by a night stick.

FIG. 2 shows a golfer 44 addressing a glow-in-the-dark golf ball 50 with a golf club 46. The area surrounding the golf ball 50 is illuminated by a light-stick 48. The light stick 48 is inserted into the round and directs a beam of light 52 at golf ball 50. As described above, glow-in-the-dark golf balls are well known to those skilled in the art and are therefore not described in detail. One type of illuminating golf ball is the Nite Lite TM manufactured by Pick Point Sports. Tee-box markers 40 and 42 are located on either side of golfer 44 when the golfer is teeing off from the tee-box 16 (FIG.

1). Alternatively, if the golf ball were located approximately half way up the fairway 18, fairway markers 36 and 38 will be on either side of the golf ball 50 (see FIG. 1). In alternative locations on the golf course, no marker may be close to the golfer 44.

Before the golfer addresses the golf ball 50, the light-stick 48 is inserted into the ground and the light beam 52 directed at the golf ball 50. The additional illumination provided by the light-stick 48 allows the golfer 44 to more clearly identify the area surrounding the golf ball. Thus, the golfer can adjust for slight variations in the ground surface that might prevent an optimal golf shot. In addition, the illumination from the light-stick eliminates possible problems a golfer can have with depth perception. Errors in depth perception could cause the golfer to strike the ground with the golf club 46 too early or too late in his golf swing. Therefore, the light-stick 48 prevents a golfer from "chunking" golf shots.

After the golfer has completed his golf swing, the golf club 46 is replaced into a golf bag (not shown) and the golf stick 48 is extracted from the ground and carried with the golfer down the fairway. Alternative lighting apparatus, such as a standard flashlight or lantern, can also be used instead of the light-stick when inserted into the ground. The light-stick, however, is designed for easy transport and provides a preferable downwardly directed beam at the golf ball. The downward light beam reduces glare that can disrupt the golfer's golf shot.

Figure 3B:
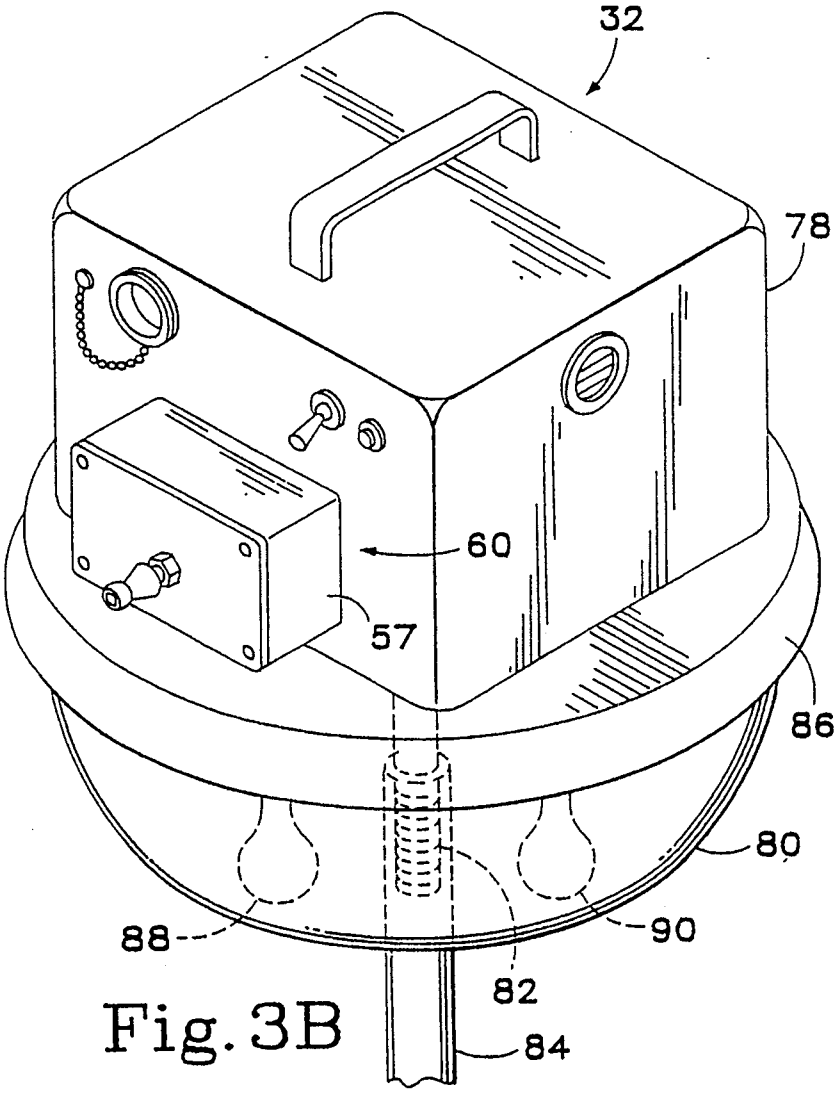
FIG. 3B shows a perspective view of the green illumination unit shown in FIG. 1.
Figure 3A:
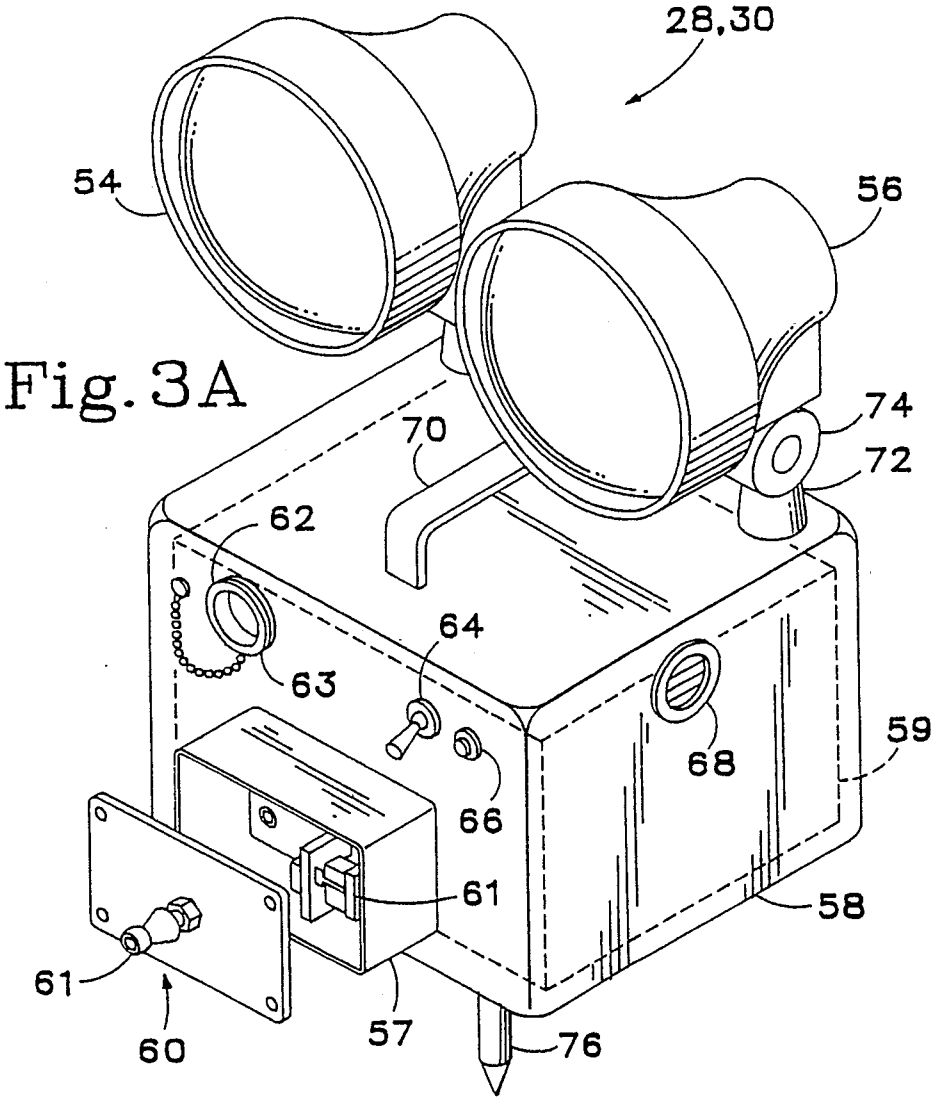
FIG. 3A shows a perspective view of the fairway illumination unit shown in FIG, 1.

FIG. 3A shows a perspective view of the fairway illumination unit 28 or 30 previously shown in FIG. 1. The unit comprises a housing 58 that contains a battery 59 and a control circuit (not shown). Lamps 54 and 56 are each pivotally coupled on a mounting 72 to the top of housing 58. The mounting 72 has a rotatable hinge 74. A carrying handle 70 is attached to the top of the housing 58. On the front side of the housing is a compartment 57 containing a photoelectric cell 60 and a relay 61. Also on the front side of the housing 58 is a power plug receptacle 62 and cap 63, an enable switch 64, and a test button 66. Multiple vents 68 are attached to various sides of the housing and a spike 76 is attached to the bottom of the housing 58.

The mounting 72 allows each lamp to pivot 360 degrees about the top of the housing in a horizontal plane and the rotatable hinge 74 allows each lamp to be rotated up and down in a vertical plane. Thus, both lamps 54 and 56 can be individually positioned at different spot locations on the golf course. The lamps 54 and 56 are conventional flood lights such as Part No. RSB 1225 manufactured by Elan. It is desirable to select a lamp that can illuminate the broadest possible area while using the least amount of energy. The handle 70 is used to lift the illumination unit out of a trailer (described below) to a predetermined location on the golf course.

The photo-electric cell 60 is a conventional photo cell such as Part No. VT-341 manufactured by Vactec. The photo-electric cell 60 measures the outside light level on the golf course and works in coordination with the control circuitry inside the illumination unit 28 to control the activation of lamps 54 and 56. The control circuitry is described in detail below with reference to FIGS. 4A and 4B. An adjustable cover 61 controls the amount of light exposure to photo-electric cell 60. The relay 61 is isolated from the inside of the housing 58 to eliminate the possible effects of sparking. Vent 68 ventilates battery 59 while preventing moisture from contaminating the inside of the housing 58. The power plug receptacle 62 is used in coordination with a power plug that is described in detail below (see FIG. 9). A power plug cap 63 is inserted into the power plug receptacle 62 to prevent water from seeping into the housing. Enable switch 64 starts normal operation of the illumination unit after installation on the golf course. Test button 66 is used to temporarily activate lamps 54 and 56 to determine lamp operation status and to determine if battery 59 has sufficient charge. Both activation switch 64 and test button 66 are described in further detail below (see FIG. 4A and 4B).

Spike 76 extends downward from the bottom of the housing 58. The spike has a pointed bottom tip that is easily inserted into the ground. The fairway illumination unit is installed by grabbing the handle 70, positioning the unit over a desired location on the golf course and inserting the spike 76 into the ground. The spike anchors the housing 58 to the ground preventing the illumination unit from being blown over by a strong wind or inadvertently knocked over by a golfer.

FIG. 3B shows a perspective view of the green illumination unit 32 (FIG. 1). The housing 78 is essentially the same as housing 58 previously shown in FIG. 3A. For example, handle 70, vents 68, power plug receptacle 62, activation switch 64, test button 66, and photoelectric cell 60 are the same as previously shown in FIG. 3A. The compartment 57 is shown in the normally closed position. The battery and control circuit inside housing 78 are also the same as those inside the housing 58 shown in FIG. 3A. A light fixture base 86 is attached to the housing 78 and receives inverted translucent domed shaped lens 80. Lamps 88 and 90 extend out of the bottom of the fixture base 86 and are covered by the lens 80.

The lens 80 is coupled to the bottom of the fixture base 86 by a threaded mounting bolt 82. Lens 80 has a hole in the bottom that receives bolt 82 and is cinched by a bolt (not shown) against the bottom of the fixture base 86. A portion of bolt 82 extends out of the bottom of the lens 80 while in the cinched position. A golf pole 84 has a threaded hole in the top that receives the portion of bolt 82 extending out of the bottom of the domed lens 80. The operation of the green illumination unit is described in further detail below in FIG. 5.

Figure 4A:
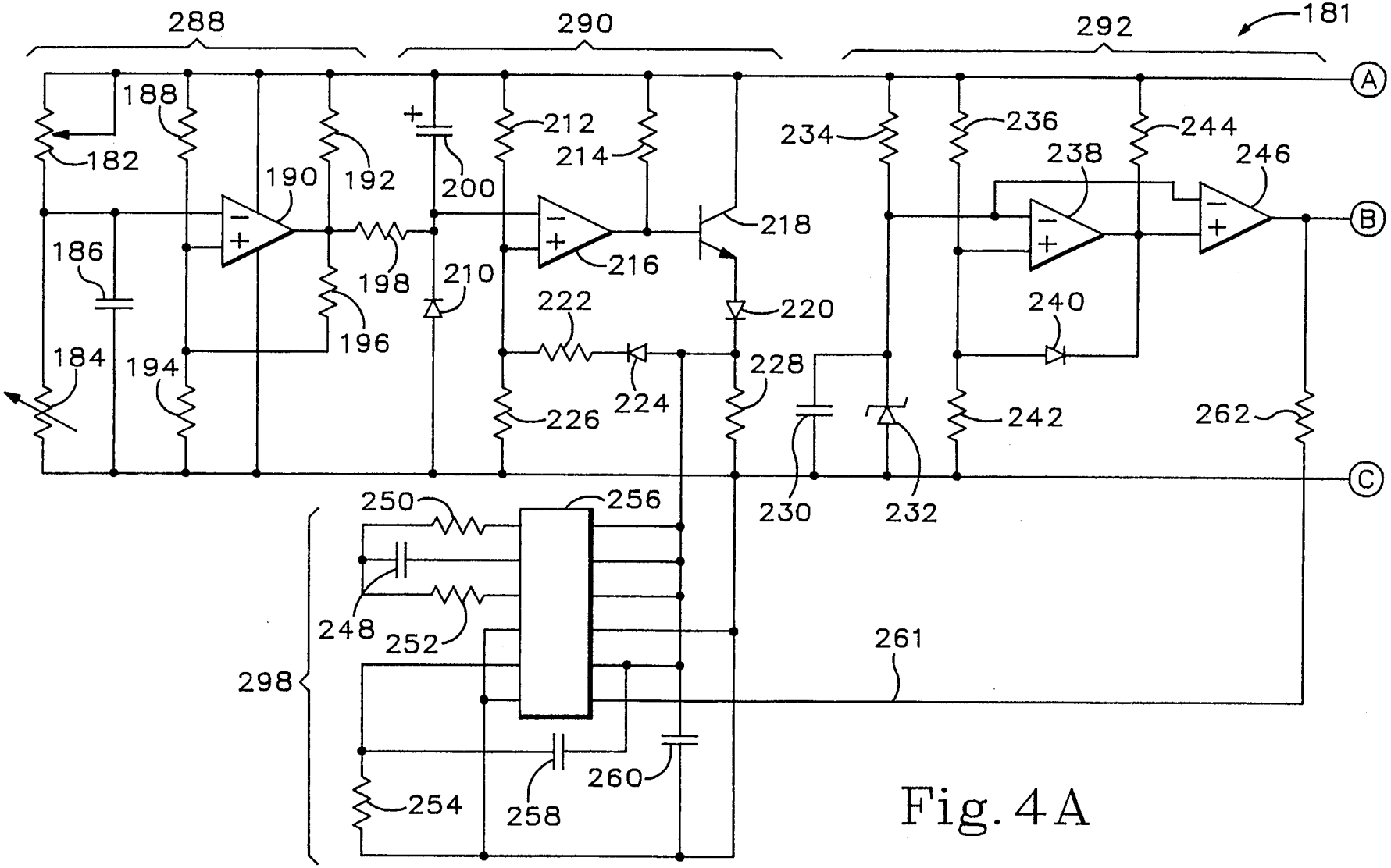
FIGS. 4A and 4B are a circuit diagram of a control circuit used for controlling the fairway and green illumination units.
Figure 4B:
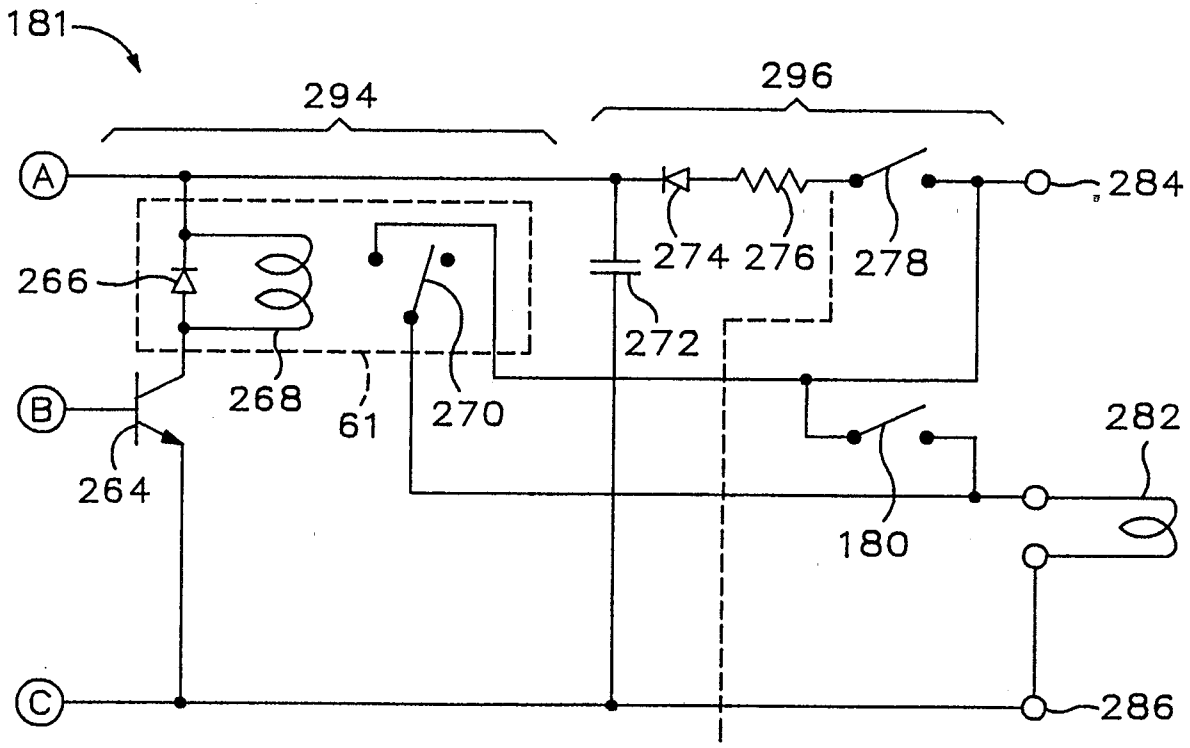

FIG. 4A is a circuit diagram of a control circuit used for controlling the fairway and green illumination units previously shown in FIGS. 3A and 3B. A light level detector circuit 288, delay and latch circuit 290, low voltage shutdown and latch circuit 292, relay circuit 294, timing circuit 298, and activate and test circuit 296 are coupled together in adjacent stages to comprise one overall control circuit 181. The light level detector circuit 288 comprises an op-amp 190 coupled at the inverting input to a voltage divider that included a potentiometer 182 and a photo-electric cell driven variable resistor 184. The variable resistor 184 changes value according to the detected light level of the photoelectric cell 60 (see FIG. 3A) and potentiometer 182 changes resistance according to a manually controlled mechanical set screw (not shown). The non-inverting input of op-amp 190 is coupled to a voltage divider comprising resistors 188 and 194. A feedback resistor 96 resistively couples the output and non-inverting input of op-amp 190 and a pull-up resistor 192 sets the non-active state for the output of op-amp 190.

Delay and latch circuit 290 comprises an op-amp 216 that receives the output of op-amp 190 at the inverting input through resistor 198. The inverting input of op-amp 216 is also coupled to capacitor 200 and a diode 210. The non-inverting input of op-amp 216 is coupled to a voltage divider including resistors 212 and 226 and to a feedback circuit including a transistor 218, diodes 220, and 224, and resistor 222. The low-voltage shut-down and latch circuit 292 comprises op-amps 238 and 246 coupled in series with the inverting inputs of each op-amp coupled to the same voltage reference circuit including resistor 234, capacitor 230 and zenor diode 232. The voltage level at the non-inverting input of op-amp 238 is set by a voltage divider that includes resistor 236 and resistor 242. The voltage on the non-inverting input of op-amp 246 is determined by the output of op-amp 238 and the voltage across resistor 244.

The timing circuit 298 is conventional and includes a timing chip such as a MC14541B manufactured by Motorola. That is wired to activate after a predetermined amount of time. The timing circuit 298 is known by those skilled in the art and is therefore not described in detail. The value of resistor 250 in timing circuit 298 is adjusted to alter the activation time. The input of circuit timer 298 is coupled to the feedback path of delay and latch circuit 290 and the output of the timer circuit drives the input of relay circuit 294. The relay circuit includes a transistor 264 that controls the operation of a relay 61 (see FIG. 3A). The relay has a coil 268 that electromagnetically controls the on/off state of a relay switch 270. The activation and test circuit 296 includes an activation switch 278 that couples a battery (FIG. 3A) to the control circuit through a resistor 276 and a diode 274. The battery is coupled between terminals 284 and 286. A test button 280 and the relay switch 270 are coupled in parallel between the battery and lamp 282.

Control circuit 181 operates in the following manner:

Potentiometer 182 is adjusted during assembly of the control circuit so that op-ampi 190 activates when photo-electric cell controlled resistor 184 reaches a predetermined value. The predetermined value of resistor 184 is proportional to the exterior light level at which golf can no longer be played without artificial lighting. As the outside light level falls below the minimum predetermined light level, their output of op-amp 190 activates delay and latch circuit 290. As the voltage level at the inverting input of op-amp 216 changes, the output of op-amp 216 becomes active enabling transistor 218. Capacitor 200 delays the voltage transition at the input of op-amp 216 to prevent intermittent lamp 282 from being intermittently turned on and off when there are temporary changes in the outside light level. For example, temporary shading of the photo-electric cell 60 (FIG. 3A) could cause temporary activation of the lamp 282.

Transistor 218 in turn activates timing circuit 298 and latches op-amp 216 by providing feed-back to the non-inverting input of op-amp 216. The active output of timer 298 enables transistor 264 causing relay coil 268 to energize and close relay switch 270. As described above, resistor 250 in timer 298 is adjusted during assembly to allow the timing circuit 298 to remain activated for a predetermined amount of time. The amount of time selected is sufficient for completion of a night golf session. After the predetermined elapsed time, timing circuit 298 automatically deactivates, disabling transistor 264. With transistor 264 disabled, relay coil 268 becomes deactivated causing relay switch 270 to move back into an open position which shuts off lamp 282. Low voltage shut down circuit 292 turns off transistor 264 if the battery output voltage is below a predetermined value. The low voltage shut off value can be altered by varying the value of resistor 242. Circuit 292 prevents battery damage from excessive discharge that could occur if the battery were trying to operate lamp 282 in a low charge state.

Figures 5, 6, 7:
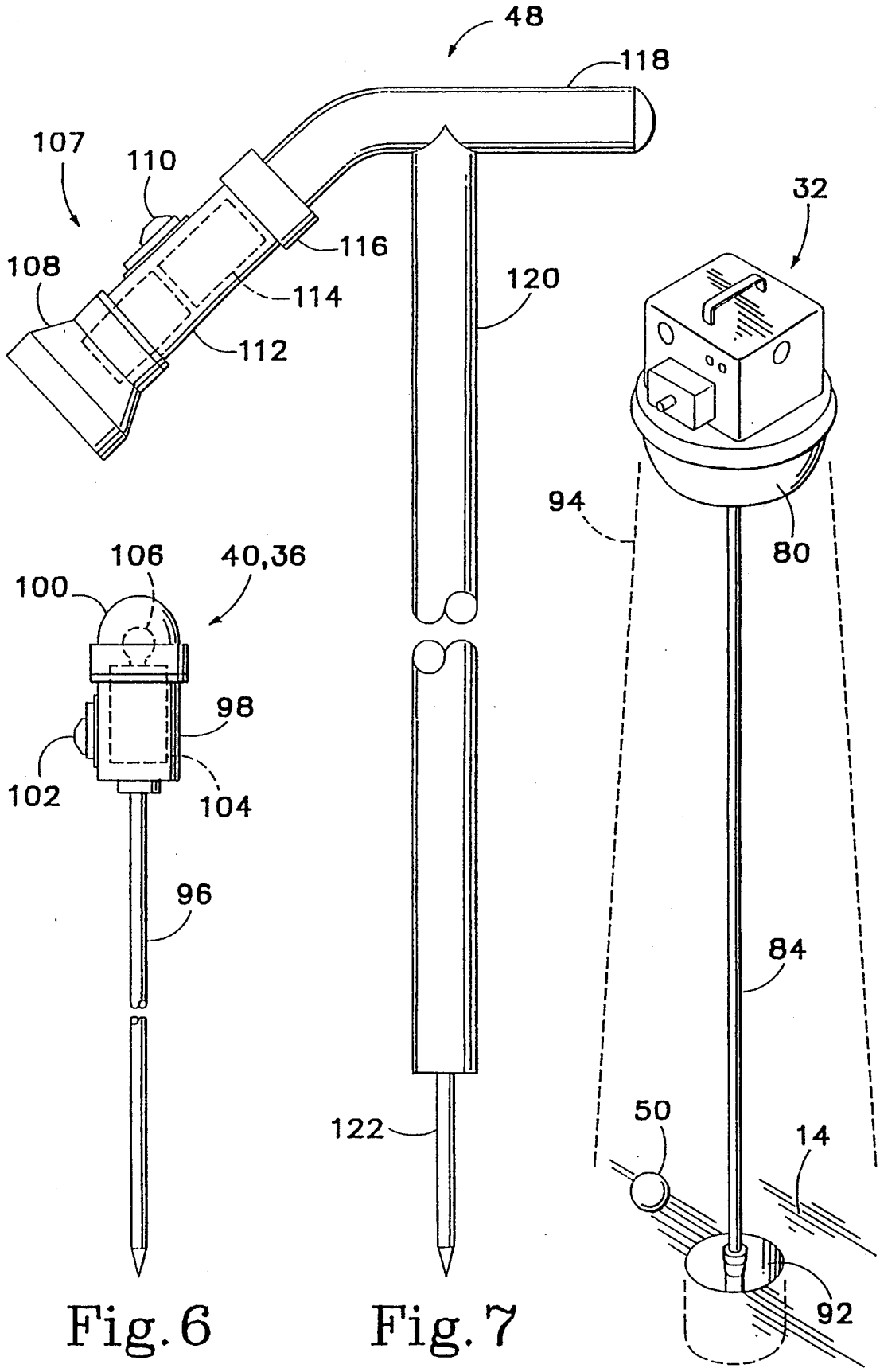
FIG. 5 shows the golf flag pole used for supporting the green illumination unit shown in FIG. 3B.
FIG. 6 shows a side view of the fairway and tee-box markers previously shown in FIG. 1.
FIG. 7 shows a side view of the light-stick previously shown in FIG. 2.

FIG. 5 shows in more detail the golf pole 84 used for supporting the green illumination unit 32 previously shown in FIG. 3B. The pole 84 is insertable into a conventional golf flag receiving structure located within a conventional golf cup 92. The golf pole 84 is made out of a strong, rigid material such as steel so that it can support the green illumination unit 32 above the ground. Golf cup 92 has either a standard 4 inch diameter or a larger 6 inch diameter. If a standard 4 inch cup is used, it may be necessary for someone to tend the golf pole 84 while a golfer is putting. However, it is also possible for a golf course to supply a larger 6 inch golf cup that would allow a golf ball to be putted into the cup 92 without having to remove golf pole 84.

Light 94 from green illumination unit 32 is directed downward around the golf green 14. The area illuminated by unit 32 is sufficient to clearly identify the location of the golf hole while approaching the golf green from the fairway (see FIG. 1). The green area is also sufficiently illuminated so that the glow-in-the-dark golf ball 50 can be replaced with a normal non-luminescent golf ball for putting.

FIG. 6 shows a side view of the fairway marker 36 or the tee-box marker 40 previously shown in FIG. 1. The markers include a light 106 attached to a case 98. The case 98 contains a power source such as a standard rechargeable D-cell battery 104 and is coupled at the top to a lens cap 100. A switch 102 is attached to the side of the case 98 and a spike 96 is attached to the bottom of the case.

The length of spike 96 varies depending upon where on the golf course the marker is going to be located. For example, it may be preferred to have a shorter spike for tee-box markers and a longer spike for fairway markers. The spikes are inserted into the ground and hold the case 98 high enough above the ground to be easily seen at a distance by a golfer. After the spike is inserted into the ground, the switch 102 is moved into an on position electrically coupling battery 104 to light 106. The light then becomes energized illuminating the area immediately surrounding the marker. The lens cap 100 can contain threads that engage with threads on the top of the case 98. However, for quicker removal of battery 104, a quick release clamp or quarter turn twist lock can also easily be used to interlock lens cap 100 to case 98. Both the fairway and green illumination units (see FIGS. 3 and 4) and the fairway and tee-box markers are completely water resistent and can be operated in a wide array of weather conditions.

FIG. 7 shows a side view of the light-stick 48 previously shown in FIG. 2. The light-stick comprises a light source 107 connected by a carry stick handle 118 to a carry stick 120. Spike 122 extends from the bottom of the carry stick 120. The light source 107 includes a battery containment section 112 coupled at the front to a lens cap 108 and coupled at the opposite end to the front end of the carry stick handle 118. The light source 107 in one embodiment can be a conventional flashlight that is insertable into a female receiving coupler 116 of carry stick handle 118. The flashlight is pressure mounted into the receiving coupler 116 and can be easily removed for use without the carry stick 120. The containment section 112 contains two rechargeable D-Cell batteries of the same type used in the fairway and tee-box markers. The light source is activated simply by moving switch 110 into an on position.

Figure 8:
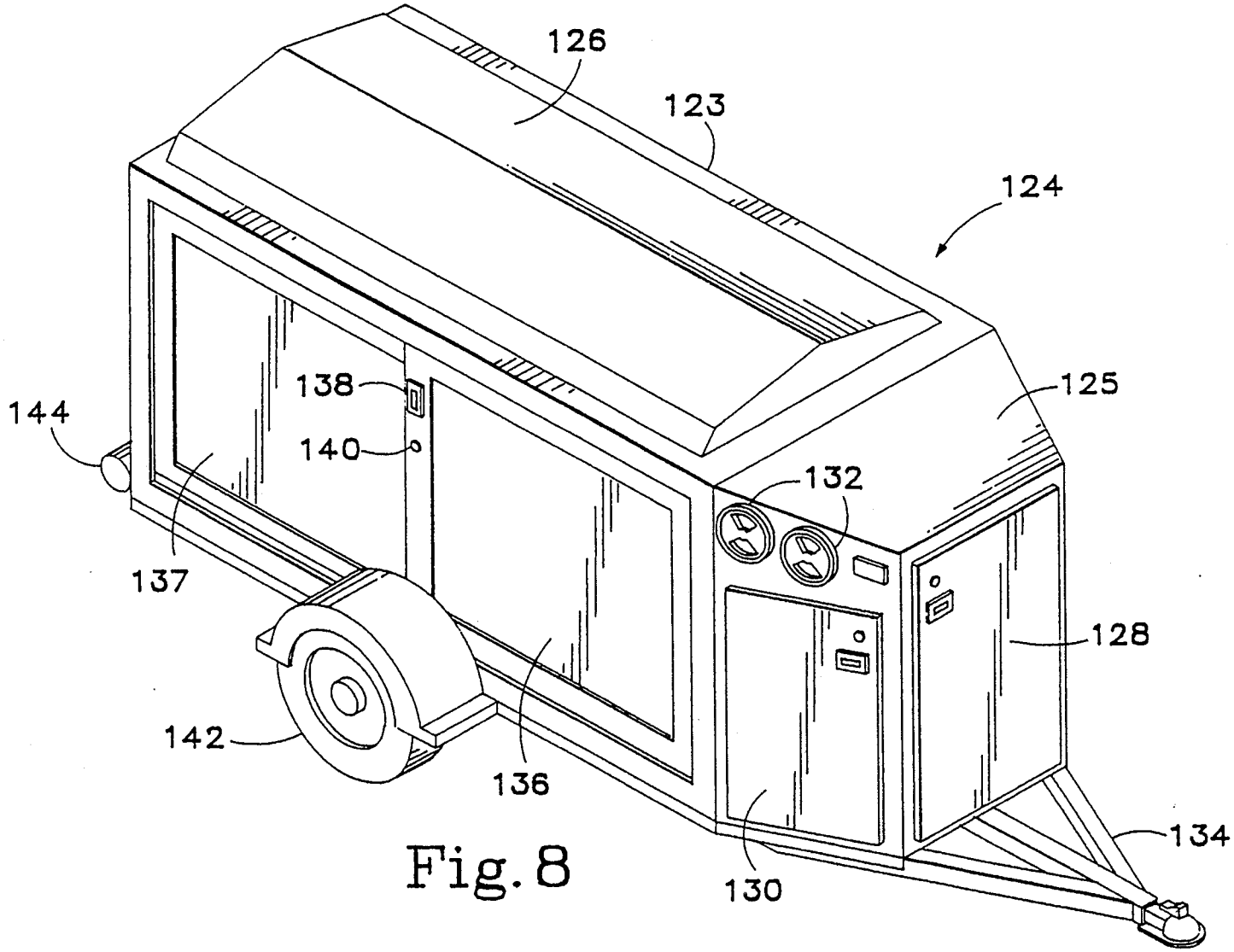
FIG. 8 shows a perspective view of a trailer used for storing and transporting other components of the night golf system.

FIG. 8 shows a perspective view of a trailer 124 used for storing and transporting the night golf system. The trailer has a main lamp containment section 123 and a front battery charger containment section 125. Lamp containment section 123 has a set of sliding doors 137 and 136 on either side of the trailer. The doors are shown in the closed position. The sliding doors can be locked shut by a lock 140 and slid open by moving the doors in a horizontal direction with door handle 138. A rear bumper 144 is attached to the back of the trailer and wheels 142 are attached on opposite sides underneath the trailer 124. A front door 128 and a side door 130 are attached to the battery charger containment section 125. Vents 132 are attached on both sides of the battery charger containment section 125 and a hitch 134 is attached underneath section 125. A golf pole containment section 126 resides on top of the trailer.

The trailer is light enough to be hauled by a golf utility vehicle, or alternatively a golf cart, and is coupled to the vehicle with hitch 134. The trailer is also outfitted with the required lighting for travel on public access roads. The wheels 142 provide sufficient ground clearance so the trailer can be easily transported to any location on the golf course where an illumination unit is required to be installed. The trailer is small enough to access all golf cart paths previously provided on the golf course for conventional golf carts. The trailer is also small enough to be easily parked in a golf course maintenance shed or in a golf course parking lot. Optionally, signs can be placed on the side doors of the trailer to identify golf tournament sponsors or the like. The trailer is water resistent and insulates the inside equipment from the environment.

Figure 9:
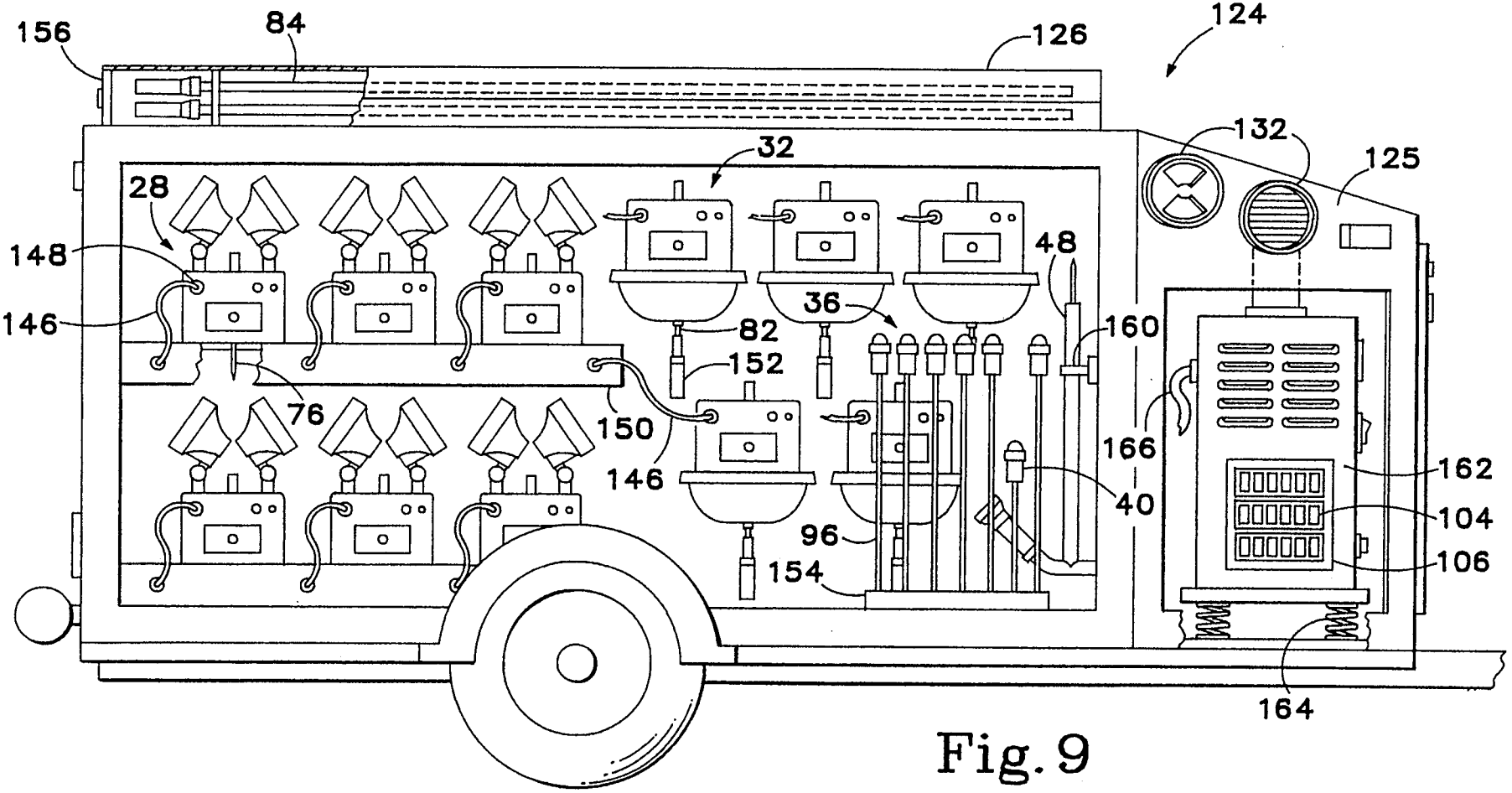
FIG. 9 shows a side view of the trailer of FIG. 8 with the doors removed but otherwise loaded for travel or recharging.

FIG. 9 shows a side view of the trailer 124 of FIG. 8 with the doors 137, 136, and 130 removed. All the golf equipment previously shown in FIGS. 1 and 2 is contained within the trailer 124. The identical configuration as shown in FIG. 9 also exists on the opposite side of the trailer. Golf poles 84 are stored horizontally in the golf pole containment section 126. The fairway illumination units 28 are stored on shelf 150 and the green illumination units 32 are held by mounting brackets 152. The fairway and green illumination units are connected to power outlet cords 146 with a power plug 148. The fairway markers 36 and the tee-box markers 40 are stored on a mounting block 154 and the light-sticks 48 are stored on a mounting clip 160. A battery charger 162 and a D-Cell battery charger 106 reside within the battery charger containment section 125.

The golf poles 84 are inserted through a rear door 156 into containment section 126. The containment section is of sufficient size to hold at least 9 golf poles and can be proportionally enlarged to contain 18 poles. Shelves 150 on either side of the trailer are of sufficient size to hold at least 18 fairway illumination units (i.e., 2 for each of nine golf holes). A mounting hole is provided in the shelf 150 for each fairway illumination unit. Each shelf hole is of sufficient size to receive spike 76 and securely hold the illumination unit to the shelf when the trailer is being hauled. Thus, the spike 76 serves the dual purpose as both an anchor for the fairway illumination unit when installed on the golf course and a mounting apparatus for securing the unit in trailer 124. The bolt 82 for each green illumination unit 32 is insertable into an associated mounting bracket 152. Thus, the bolt 82 also serves the dual function of attaching the green illumination unit to the top of golf pole 84 and securing the unit to the mounting bracket 152 in the trailer 124. The mounting block 154 has holes that receive the spikes of both the fairway and tee-box markers and the mounting chip 160 has sufficient clips to hold multiple light-sticks.

Battery charger 162 is a multiple parallel battery charger such as Model No. 6066 manufactured by Associated Industries and is operated off of a standard 220 VAC outlet. However, an alternate battery charger can be used that is powered by a 120 VAC power supply. The battery charger 162 produces a 12 VDC power supply that is used for charging the batteries within the fairway and green illumination units. In,addition, the battery charger 162 provides a 120 VAC power supply for operating the $1\frac{1}{2}$ VDC D-Cell charger 106. The 12 volt battery charger output is coupled to each of the power outlets by a positive and a negative bus bar (not shown). The two bus bars are run throughout the trailer 124 and tapped at convenient locations by individual power outlet cords, for example cords 146. The power outlet cords 146 are then inserted into the power receptacle of an associated illumination unit for charging the enclosed battery. The overall wiring configuration of the trailer 124 is explained in more detail below (See FIG. 10). Blower units (not shown) reside behind vents 132 to blow fresh air on battery charger 162 and to further vent the trailer while the doors are closed. The battery charger 162 is coupled to the floor of trailer 124 by springs 164 to reduce vibrational shock when the trailer is moving.

It is important to note that the shelf and mounting apparatus within the trailer are designed for quick storage and removal of the night golf system. In addition, the power plugs 148 and D-Cell charger mounting rack 106 are designed so that the batteries from the illumination units and the markers can be quickly connected and disconnected from battery charger 162. This quick connect/disconnect capability reduces the amount of time required to install the lighting system on a golf course and to reload the system in the trailer after the completion of a night golf session.

Figure 10:
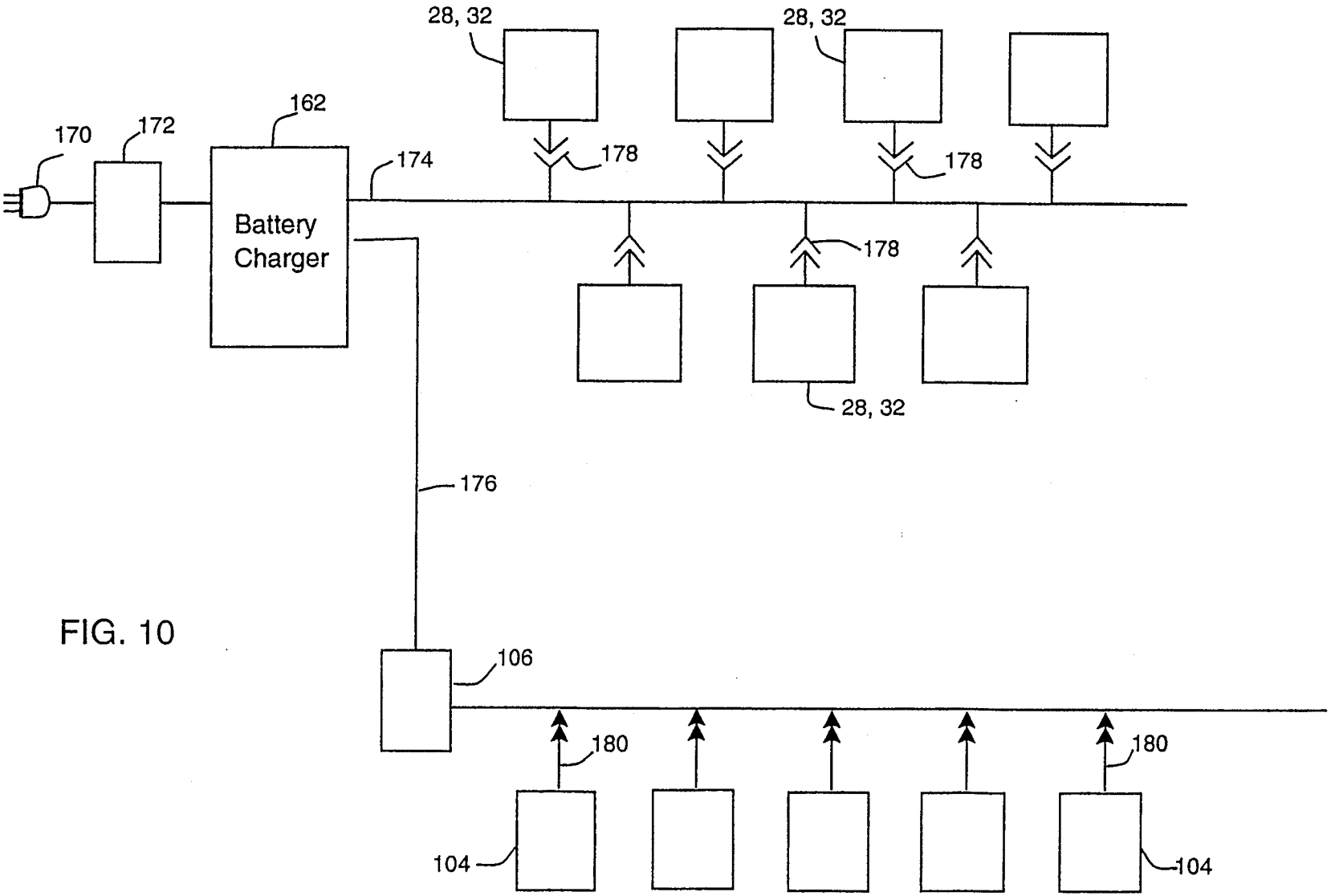
FIG. 10 is a circuit diagram of the power distribution system used in the trailer previously shown in FIG. 8.

FIG. 10 is a circuit diagram of the power distribution system residing within trailer 124 (FIG. 9). A standard electrical outlet 170 is coupled through a voltage meter 172 to the battery charger 162 (FIG. 9). The battery charger is coupled to a 12 VDC power bus 174 that runs the interior of the trailer 124 (FIG. 9). The power bus 174 is coupled by the insertable power plugs 178 into either fairway illumination units 28 or green illumination units 32 (FIG. 9). A 120 VAC power bus 176 runs from the battery charger 162 to the D-Cell charger 106 as previously shown in FIG. 9. The charger 106 is electrically coupled to various outlet clips 180 that receive and connect the D-Cell batteries 104 to charger 106.

The fairway and green illumination units can be interchanged between different 12 VDC power outlets 178 and the D-Cell batteries from the fairway and tee-box markers and the light-sticks can be placed in any one of the clips 180. The voltage meter 172 monitors the voltage level of the local municipal power supply and disables the power supply from battery charger 162 in the event of a power surge, brown out, or consistent overvoltage condition. Thus, the voltage meter protects the battery charger and the batteries-from potential damage from a fluctuating power supply.

To further explain how all the different pieces of night golf system work together, the complete operation of the system is briefly described. The trailer is initially hauled to a golf course location by a street approved motorized vehicle to the golf course where the night golf session will be played that night. Initially, all the equipment including the fairway markers and illumination units, green illumination units, tee-box markers, night sticks, and golf poles are stored in the trailer (FIG. 9). The batteries from the night sticks and the fairway and tee-box markers are inserted into the D-Cell battery rack and the illumination units are plugged into one of the power outlets (FIG. 9). When the night golf equipment is ready to be installed on the golf course and the batteries are sufficiently charged, the D-cell batteries are placed back into the markers and light-sticks.

The trailer is then attached to a golf course utility vehicle and the markers and illumination units are installed at predetermined locations around each golf hole, as previously illustrated in FIG. 1. Preselected positions for each marker and illumination unit are selected where the light provides the most effective recognition of the golf course layout at night without counteracting the desirable contrast between the glow-in-the-dark golf ball and the golf course backdrop. At the predetermined fairway illumination unit location, the power outlet is removed from the unit. The unit is then removed from the trailer and the metal spike attached to the bottom of the unit is inserted into the ground. The fairway illumination unit is then enabled by pressing the activation switch. To determine if the battery and the lamps of the fairway illumination unit are operating correctly, the test button is pressed. The lamps are then directed at the predetermined spot locations previously described.

On the golf course green, a green illumination unit is attached to the top of one of the golf poles. The conventional golf flag, presently residing in the golf cup is removed and the golf pole inserted into the green. If a larger golf cup is used for the night golf session, the presently exposed golf cup is covered and the cover from the larger 6" hole cup is removed. The green illumination unit is then enabled and tested in the same manner as the fairway illumination unit. The fairway and green illumination units then automatically turn when the outside light level falls below the predetermined light level.

During the night golf session, each golfer is given a light-stick and multiple glow-in-the-dark golf balls. The golfer is directed to each golf hole tee-box by the tee-box markers. When teeing off, the golfer knows the general location in which to direct his shot by the fairway markers and illumination units, and possibly by the green illumination unit, if within sight of the tee-box. The golfer, after hitting the golf ball, can see the precise direction in which the golf ball is traveling because of the substantially dark backdrop. The golfer then picks up the light-stick and travels in the direction of the golf ball. The light-stick illuminates the navigational path of the golfer while walking or driving toward his golf ball.

The substantially dark ground surface provides a sharp contrast for the golf ball after it returns to the ground. This sharp contrast makes it easy for the golfer to "hone in" on the precise location of his ball after localizing his search to a specific area. This is different than conventional night golf lighting schemes where any golf ball landing outside a lighted area would be virtually impossible to find. In addition, the dull contrast between either a conventional golf ball or a glow-in-the-dark golf ball, and the highly illuminated areas on a conventionally lit golf course would make it difficult to identify the golf ball even in a highly illuminated location. After the golfer locates his golf ball, the light-stick is inserted into the ground and directed at the glow-in-the-dark golf ball. The green illumination unit, if in sight at this point, and the fairway illumination units, direct the golfer for the appropriated approach shot to the green. On the green, the green illumination unit provides sufficient light for the golfer to putt the glow-in-the dark golf ball or a conventional golf ball. After putting out, the golfer is directed to the next golf hole by the tee-box markers associated with the next golf hole.

A specific amount of time after the golf session is over, the illumination units automatically shut off. The lights can be picked up before the illumination units automatically shut off or can be picked up in the morning. The fairway and tee-box markers are returned to the trailer and their batteries returned to the 1½ volt charger. The fairway illumination units are returned to the trailer shelf and plugged into a power outlet for recharging. The green illumination units are removed from the associated golf pole and the conventional golf flag put back into the golf cup. The illumination unit is returned to the trailer for recharging and the poles returned to the trailer for storage.

If the present golf course is the location of the next night golf session, the trailer is returned to an appropriate location where the battery charger is plugged in and activated to begin battery charging. If an alternate golf course is the location of the next night golf session, the trailer is attached to the appropriate street vehicle and hauled to the new golf course. The trailer is then hooked up to an appropriate power outlet at the new golf course and the batteries charged for the forthcoming night golf session, prior to the night golf session, the night golf system is installed at predetermined locations on the new golf course that provide the most effective lighting scheme. Thus, the night golf system also provides an effective inexpensive way of lighting multiple golf courses.

Having described and illustrated the principles of the invention in a preferred embodiment thereof, it should be apparent that the invention can be modified in arrangement and detail without departing from such principles. I claim all modifications and variation coming within the spirit and scope of the following claims.

I claim:

1. A method of playing golf at night on a golf course comprising:

providing a glow-in-the-dark golf ball having a high illumination contrast with a dark exterior light level; illuminating only predetermined spot locations on the golf course and various hazards of each golf hole on the golf course;

providing illumination units each having a light beam for illuminating said spot locations;

maintaining the golf course, other than the illuminated predetermined spot locations, substantially unlit, so that substantially the entire fairway on each golf course hole remains unlit with a dark sky backdrop and a dark ground level, wherein each fairway extends from a tee location along a central axis to an associated golf green;

illuminating said spot locations with the illumination units while the light beams are directed away from the fairway central axis; and playing golf with the glow-in-the-dark golf ball while only the spot locations around the perimeter of the golf course exist in an illuminated state thereby allowing the golfer to identify discontinuities and hazards in the golf course while at the same time maintaining a constant sharp illumination contrast between the glow-in-the-dark golf ball and the exterior light level along a standard flight trajectory and landing path for various locations on the fairway.

2. A method according to claim 1 wherein the course includes a plurality of holes, each hole having a corresponding green, a conventional cup located in the green, and a portable golf flag readily inserted and temporarily supported by a conventional receptor located inside the cup and further comprising the steps of:

rigidly attaching an illumination unit to the top of the golf flag thereby illuminating the golf green for identifying a location of the corresponding golf green cup;

removing a conventional golf flag from the golf flag receptor and temporarily inserting the golf flag with the attached illumination unit into the cup prior to a night golf session, the illumination sufficiently lighting the golf green so that the golfer can exchange the glow-in-the-dark golf ball with a standard non-illuminating golf ball for putting; and removing the golf flag and the attached illumination unit from the cup and inserting the conventional golf flag back into the receptor after completion of the night golf session.

3. A method according to claim 1 further comprising:

providing the illumination units with a rechargeable power supply, the illumination units capable of being lifted by hand and transported to various locations on the golf course;

locating the multiple spot locations outside a periphery of each fairway on the golf course such that when illuminated with the fairway illumination units allow a golfer to identify the general layout of the corresponding hole; and temporarily mounting each fairway illumination unit directly into the ground in a single stationary position next to an associated predetermined spot location along a longitudinal path of each golf course fairway prior to the night golf session;

directing the light beam of each illumination unit at the associated spot location along the outside periphery of the fairways;

extracting each fairway illumination from the ground after completion of a night golf session.

4. The method of claim 3 including transporting and installing the illumination units at different golf courses, the illumination units installed at one specific golf course prior to the beginning of a night golf session.

5. The method of claim 3 wherein the illumination units are transported to the various spot locations on the golf course in a trailer, the trailer including a watertight lockable chamber having sufficient space for storing all the illumination units when not located on the golf course while at the same time being light enough to be hauled by a conventional golf cart and small enough to travel within a cart path provided on the golf course for said conventional golf cart.

6. The method of claim 3 including recharging the illumination units before each night golf session, each unit capable of maintaining a charge of sufficient length to illuminate an associated spot location for at least one night golf session.

7. The method according to claim 1 including illuminating hazards around each golf course that typically cannot be identified by a golfer at night.

8. The method of claim 1 including illuminating small reference locations at predetermined distances from each golf hole green, the illuminated reference locations providing only sufficient light to be identified by the golfer as a distance reference point while at the same time maintaining the area surrounding the reference location in substantial darkness.

9. The method of claim 1 wherein the area around each golf green is illuminated from a variable location positioned directly above a repositionable golf hole thereby identifying variable positions of the golf holes on the associated golf greens.

10. The method of claim 1 including illuminating the golf course tee-boxes for identifying at night the tee off locations on the golf course.

11. A method according to claim 1 wherein the majority of the illuminated spot locations are located outside the periphery of the golf course fairways.

12. A method according to claim 1 wherein the golf course is of a size and layout sanctioned for regulation play by the Professional Golfers Association.

13. A method of playing golf at night on a golf course comprising:

providing a glow-in-the-dark golf ball having a high illumination contrast with a dark exterior light level;

providing multiple fairway illumination units each having a light source generating a light beam and a rechargeable power supply, the illumination units lifted by hand and transported to various locations on the golf course;

identifying multiple spot locations outside a periphery of each fairway on the golf course that when illuminated with the fairway illumination units allow a golfer to identify the general layout of the corresponding hole;

temporarily mounting each fairway illumination unit directly into the ground in a single stationary position next to an associated predetermined spot location along a longitudinal path of each golf course fairway prior to the night golf session;

directing the light beam of each illumination unit at the associated spot location along the outside periphery of the fairways;

illuminating only predetermined spot locations on the golf course and various hazards of each golf hole on the golf course while maintaining the golf course, other than the illuminated predetermined spot locations, substantially unlit, so that substantially an entire fairway on each golf course hole remains unlit with a dark sky backdrop and a dark ground level;

playing golf with the glow-in-the-dark golf ball while only the spot locations around the perimeter of the golf course exist in an illuminated state thereby allowing the golfer to identify discontinuities and hazards in the golf course while at the same time maintaining a constant sharp illumination contrast between the glow-in-the-dark golf ball and the exterior light level along a standard flight trajectory and landing path for various locations on the fairway;

extracting each fairway illumination from the ground after completion of a night golf session;

the illumination units transported to the various spot locations on the golf course in a trailer, the trailer including a watertight lockable chamber having sufficient space for storing all the illumination units when not located on the golf course while at the same time being light enough to be hauled by a conventional golf cart and small enough to travel within a cart path provided on the golf course for said conventional golf cart; and separately coupling each illumination unit inside the trailer chamber to a charging unit also located inside the trailer chamber thereby recharging all the illumination units at the same time while stored in the trailer chamber.

14. A method of playing golf at night on a golf course comprising:

providing a glow-in-the-dark golf ball having a high illumination contrast with a dark exterior light level;

providing multiple fairway illumination units each having a light source generating a light beam and a rechargeable power supply, the illumination units lifted by hand and transported to various locations on the golf course;

identifying multiple spot locations outside a periphery of each fairway on the golf course that when illuminated with the fairway illumination units allow a golfer to identify the general layout of the corresponding hole;

temporarily mounting each fairway illumination unit directly into the ground in a single stationary position next to an associated predetermined spot location along a longitudinal path of each golf course fairway prior to the night golf session;

automatically activating some of the illumination units after being installed on the golf course, the illumination units activating a predetermined amount of time after the outside light level falls below a predetermined level for eliminating false activation due to intermittent shading at the spot locations and deactivating a given amount of time after activation substantially equal to the period of time required to complete the night golf session;

directing the light beam of each illumination unit at the associated spot location along the outside periphery of the fairways;

illuminating only predetermined spot locations on the golf course and various hazards of each golf hole on the golf course;

maintaining the golf course, other than the illuminated predetermined spot locations, substantially unlit, so that substantially an entire fairway on each golf course hole remains unlit with a dark sky backdrop and a dark ground level;

playing golf with the glow-in-the-dark golf ball while only the spot locations around the perimeter of the golf course exist in an illuminated state thereby allowing the golfer to identify discontinuities and hazards in the golf course while at the same time maintaining a constant sharp illumination contrast between the glow-in-the-dark golf ball and the exterior light level along a standard flight trajectory and landing path for various locations on the fairway; and extracting each fairway illumination from the ground after completion of a night golf session.

15. A method of playing golf at night on a golf course comprising:

providing a glow-in-the-dark golf ball having a high illumination contrast with a dark exterior light level;

illuminating only predetermined spot locations on the golf course and various hazards of each golf hole on the golf course;

maintaining the golf course, other than the illuminated predetermined spot locations, substantially unlit, so that substantially the entire fairway on each golf course hole remains unlit with a dark sky backdrop and a dark ground level;

playing golf with the glow-in-the-dark golf ball while only the spot locations around the perimeter of the golf course exist in an illuminated state thereby allowing the golfer to identify discontinuities and hazards in the golf course while at the same time maintaining a constant sharp illumination contrast between the glow-in-the-dark golf ball and the exterior light level along a standard flight trajectory and landing path for various locations on the fairway;

providing a light-stick having a horizontally aligned top member with a downwardly angled section slidingly attached to a portable flashlight and a vertically aligned carrying stick attached at a top end to the top member and having a vertically aligned downwardly extending spike protruding from a bottom end for holding the support member above the ground in an upright position;

carrying the light-stick with the attached flashlight in a golfer's hand during a golf session for illuminating the area around the golfer while navigating around the golf course;

inserting the carrying stick spike into the ground before addressing the golf ball for a golf shot, the carrying stick holding the flashlight above the ground at a downward angle;

directing the flashlight at the golf ball to illuminate the area surrounding the golf ball; and extracting the spike from the ground after the golfer completes a golf shot.

16. A method for playing golf at night on a golf course comprising:

providing a glow-in-the-dark golf ball having a high illumination contrast with a dark exterior light level; illuminating only predetermined spot locations on the golf course and various hazards of each golf hole on the golf course;

providing multiple fairway illumination units each having a light source generating a light beam and a rechargeable power supply, the illumination units lifted by hand and transported to various locations on the golf course;

identifying multiple spot locations outside a periphery of each fairway on the golf course that when illuminated with the fairway illumination units allow a golfer to identify the general layout of the corresponding hole;

temporarily mounting each fairway illumination unit directly into the ground in a single stationary position next to an associated predetermined spot location along a longitudinal path of each golf course fairway prior to the night golf session, the light source of each illumination unit located near ground level and the light beam from each illumination unit directed upwards and away from the associated fairway;

directing the light beam of each illumination unit at the associated spot location along the outside periphery of the fairways;

maintaining the golf course, other than the illuminated predetermined spot locations, substantially unlit, so that substantially the entire fairway on each golf course hole remains unlit with a dark sky backdrop and a dark ground level;

playing golf with the glow-in-the-dark golf ball while only the spot locations around the perimeter of the golf course exist in an illuminated state thereby allowing the golfer to identify discontinuities and hazards in the golf course while at the same time maintaining a constant sharp illumination contrast between the glow-in-the-dark golf ball and the exterior light level along a standard flight trajectory and landing path for various locations on the fairway; and extracting each fairway illumination from the ground after completion of a night golf session.

* * * * *